US005740717A

United States Patent [19]

Sowden et al.

[11] Patent Number: 5,740,717

[45] Date of Patent: Apr. 21, 1998

[54] BLISTER PACKAGE SCORING MACHINE

[75] Inventors: Harry Sowden, Southampton; Kenneth E. Fuller, Lansdale, both of Pa.

[73] Assignee: McNeil-PPC, Inc., Skillman, N.J.

[21] Appl. No.: 770,022

[22] Filed: Dec. 19, 1996

[51] Int. Cl.[6] ..... B26F 1/40

[52] U.S. Cl. ..... 83/879; 83/881; 83/883; 83/697; 83/688

[58] Field of Search ..... 83/879, 880, 881, 83/883, 658, 697, 679, 684, 685, 687, 688, 689, 34, 35, 425.2, 425.3

[56] References Cited

U.S. PATENT DOCUMENTS

| | | | |
|---|---|---|---|
| 2,997,907 | 8/1961 | Constantino | 83/685 |
| 3,216,299 | 11/1965 | Stoeckli | 83/685 |
| 3,405,582 | 10/1968 | Eichenberger | 83/679 |
| 3,532,016 | 10/1970 | Lane | 83/685 |
| 3,771,401 | 11/1973 | Jasinski | 83/679 |
| 4,086,837 | 5/1978 | Dyck | 83/685 |
| 4,130,040 | 12/1978 | Donnelly, Sr. et al. | 83/685 |
| 4,552,050 | 11/1985 | Grefe | 83/685 |
| 4,947,718 | 8/1990 | Whistler | 83/685 |
| 5,025,691 | 6/1991 | Deni | 83/685 |

*Primary Examiner*—Maurina T. Rachuba
*Attorney, Agent, or Firm*—Paul A. Coletti

[57] ABSTRACT

In contrast to typical machines though, the present invention discloses a device which allows the plate to "float" within the mechanism, so that any inaccuracies in dimensional tolerances between plate and knife are absorbed in a damping of the plate or bed of the mechanism. In this situation, the depth of the cut of the score line can be very reliably controlled, which results in the repeatable manufacturing of a child resistant, yet senior effective package. There is used a spring pre-load for this plate, which is such that cutting takes place yet, as the tool closes, the plate and package come in "metal to metal" contact, assuring "near perfect" cuts of the blister package. Extremely high tolerances are maintained, assuring packages which pass all levels and types of QA testing.

9 Claims, 4 Drawing Sheets

BLISTER PACKAGE SCORING MACHINE

FIELD OF THE INVENTION

Generally, this invention relates to a machine which score cuts blister packages. More specifically, this invention relates to such a machine used to score cut blister packages, such packages being useful to hold tablets, and more specifically, analgesic tablets.

BACKGROUND OF THE INVENTION

Scored blister packages which hold analgesic tablets are known in the art. These score cut blister packages are useful to hold the tablet within a sealed blister and yet, provide an easy to open package upon usage. The user separates the package by bending it at the score line, and then removes a peelable surface from the blister containing the tablet.

Typically, the depth of the score mark in the blister package has been of no great consequence. However, it has been recently shown that the depth of the score mark will significantly enhance the ability of the blister package to pass child resistance (C.R.) tests, as well as senior effectiveness (S.E.) tests. Child resistance tests gauge the ability of a child to successfully open a package within a prescribed time, prior and after having been shown by an adult the proper manner to open the package. Senior effectiveness tests help determine whether typical seniors, can successfully open the package.

It has been shown through C.R. testing that as the score cut deepens the blister package becomes senior effective and as the cut becomes shallower, the blister package becomes more child resistant. A score cut depth can be established that creates the optimal C.R./S.E. blister package. Cut depth settings differing by as little as 0.001 inches have shown clear effects in the C.R. test data. Thus new relevance has been placed on the depth of the score in the blister package.

The standards for C.R. and S.C. tests vary, but generally they are evaluated according to the following criteria. For a test package to pass a C.R. test, a group of 200 children aged 3 ½–4 ½ are shown how to open the package. Then, these children are asked to individually open the package. If 80% of the children cannot open the package, it is considered to pass the test. On the other hand, if 90% of seniors (age 65–70) are able to open the device (in other words, the physical qualities of the device are such that 90% of the seniors are able to open the package even in light of its seeking to deter the opening by children), then it is considered to pass the S.C. test.

Typically, attention has turned to steel punch machines such as are well known in the industrial arts, in order to manufacture such blister packages. Essentially, these machines contain mechanisms (typically plates or feed mechanisms) which are placed thereon and are moved perpendicularly with respect to the direction of movement of the packages. A stamping process takes place, and the blister scores are made on the package.

SUMMARY OF THE INVENTION

In contrast to typical machines though, the present invention discloses a device which allows the plate to "float" within the mechanism, so that any inaccuracies in dimensional tolerances between plate and knife are absorbed in a damping of the plate or bed of the mechanism. In this situation, the depth of the cut of the score line can be very reliably controlled, which results in the repeatable manufacturing of a child resistant, yet senior effective package.

There is used a spring pre-load for this plate, which is such that cutting takes place yet, as the tool closes, the plate and package come in "metal to metal" contact, assuring "near perfect" cuts of the blister package. Extremely high tolerances are maintained, assuring packages which pass all levels and types of QA testing.

BRIEF DESCRIPTION OF THE DRAWINGS

The foregoing invention will be better understood in examining the following drawings in connection with the Detailed Description of the Invention, wherein.

DETAILED DESCRIPTION OF THE INVENTION

Figure 1:
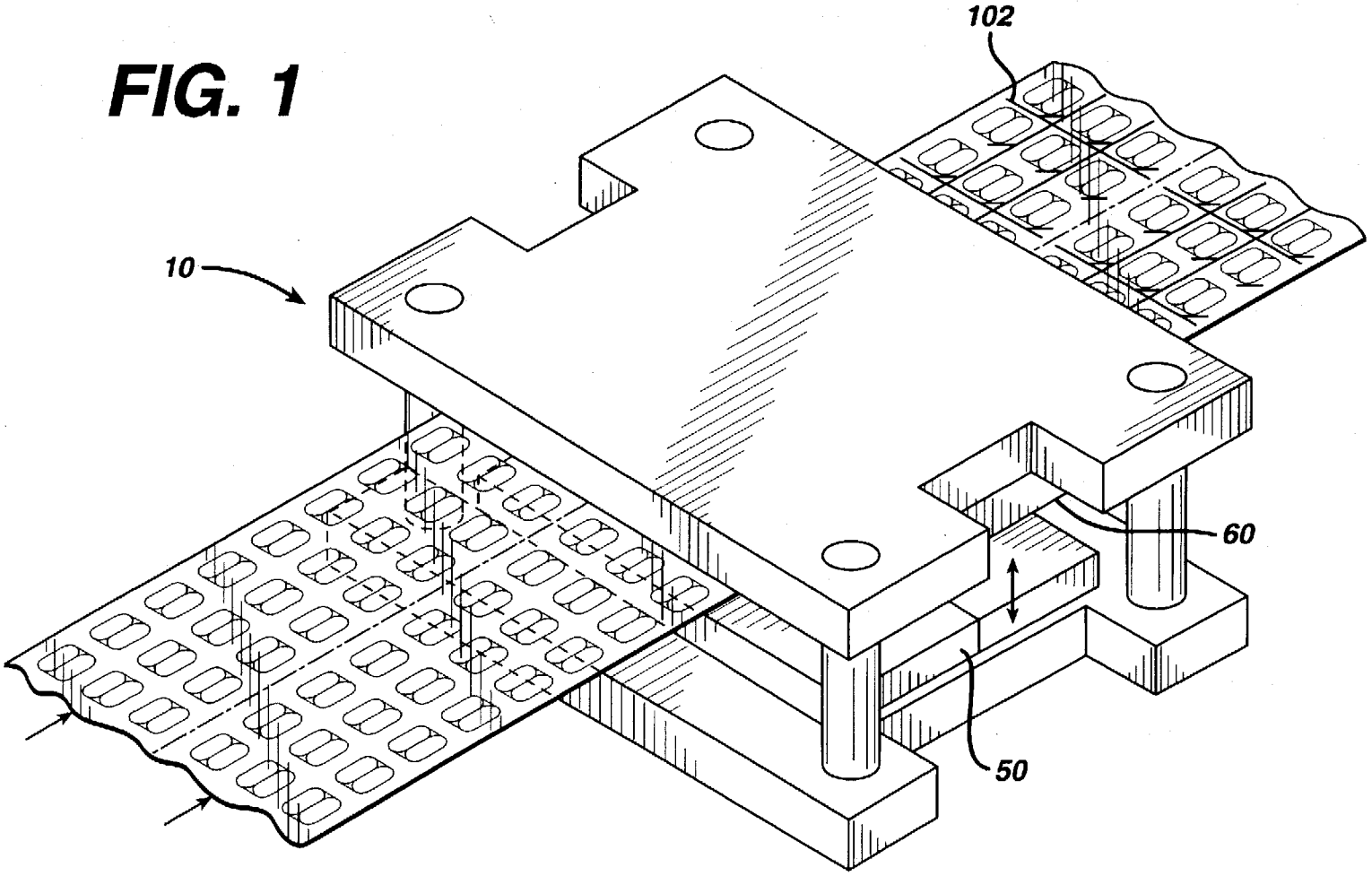
FIG. 1 is a perspective view of a blister package cutting machine which incorporates the present invention.
Figure 2:
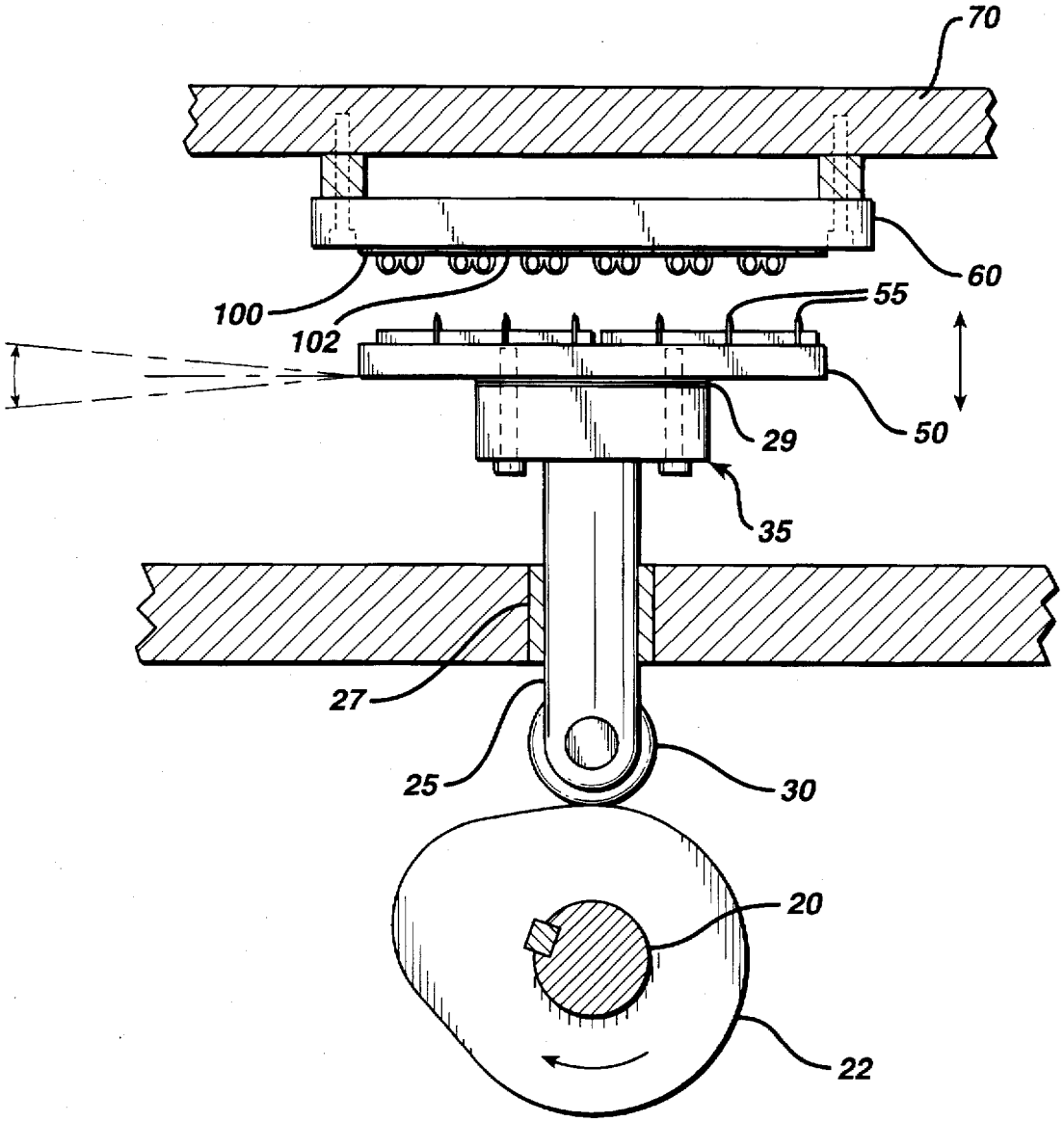
FIG. 2 PRIOR ART
FIG. 2 is a schematic of the process used by the prior art machines used to cut blister packages.

As seen in FIGS. 1 and 2, in "typical" blister cutting machines 10, there are contained a cam shaft 20, containing cam 22 which drives a cam follower 30. This cam follower 30 moves perpendicular to the axis 25 of shaft 20, which is driven by means of conventional operating mechanisms such as those are normally found and well known in the art. A knife or cutting device 50 sits at one end 35 of cam follower 30, and contains a plurality (generally two or more) knives 55. The knives 55 forms score cuts in the blister film material 100 which sits on the stationary bed surface 60 of the plate 70.

Thus, the prior art devices as principally disclosed are subject to four potential factors which can contribute to tolerance of inaccuracies in cutting. First, there may be wear of the cam 22 or cam follower 30. This can cause the depth of cut to vary widely dependent on the wear and tear of the cam 22 or follower 30. Second, wear of the axis or driver 25 of the cam shaft 20 will cause the device to be inaccurate. Because the depth of cut is controlled by the stroke of the cam, any wear thereto would result in inaccuracies in the blister cut. Third, any angular misalignment due to tilting of the guide 27 or bearing surfaces 29 on the knife device 50, as well as tilt of bed surface 60, will result in an error of depth of score line in center cuts made in the blister package. Fourth, any angular or dimensional inaccuracy due to collection of particles on the many mounting surfaces of the prior art devices can also result in inaccuracy during cutting; that is, any burrs, dust particles, etc. on the surface of the bed 60, or on the blister package 100 will also form a potential for any inaccuracy in the score lines 102 made in package 100 being cut.

Figure 3:
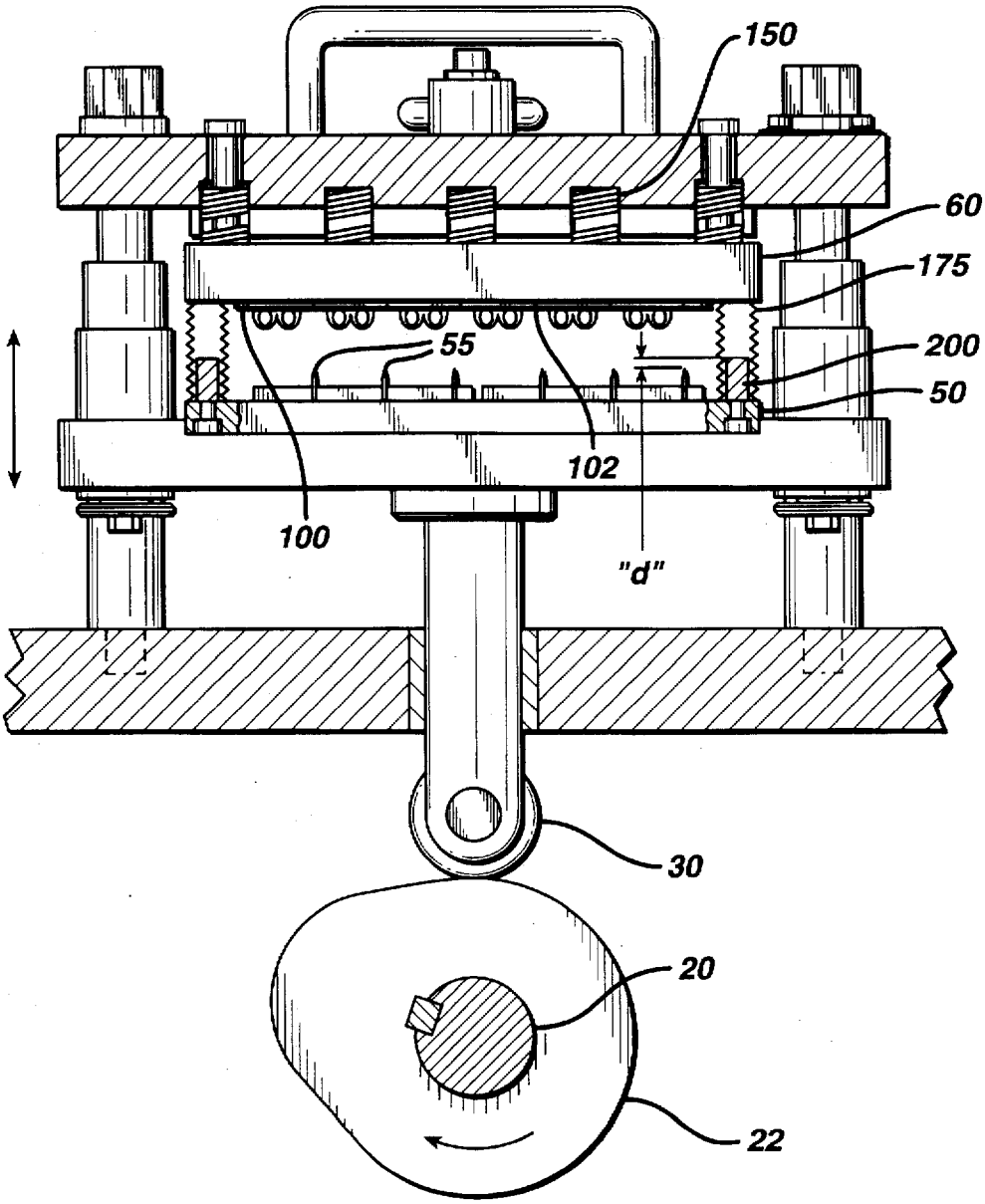
FIG. 3 is a schematic of the improvement to FIG. 1.
Figure 4:
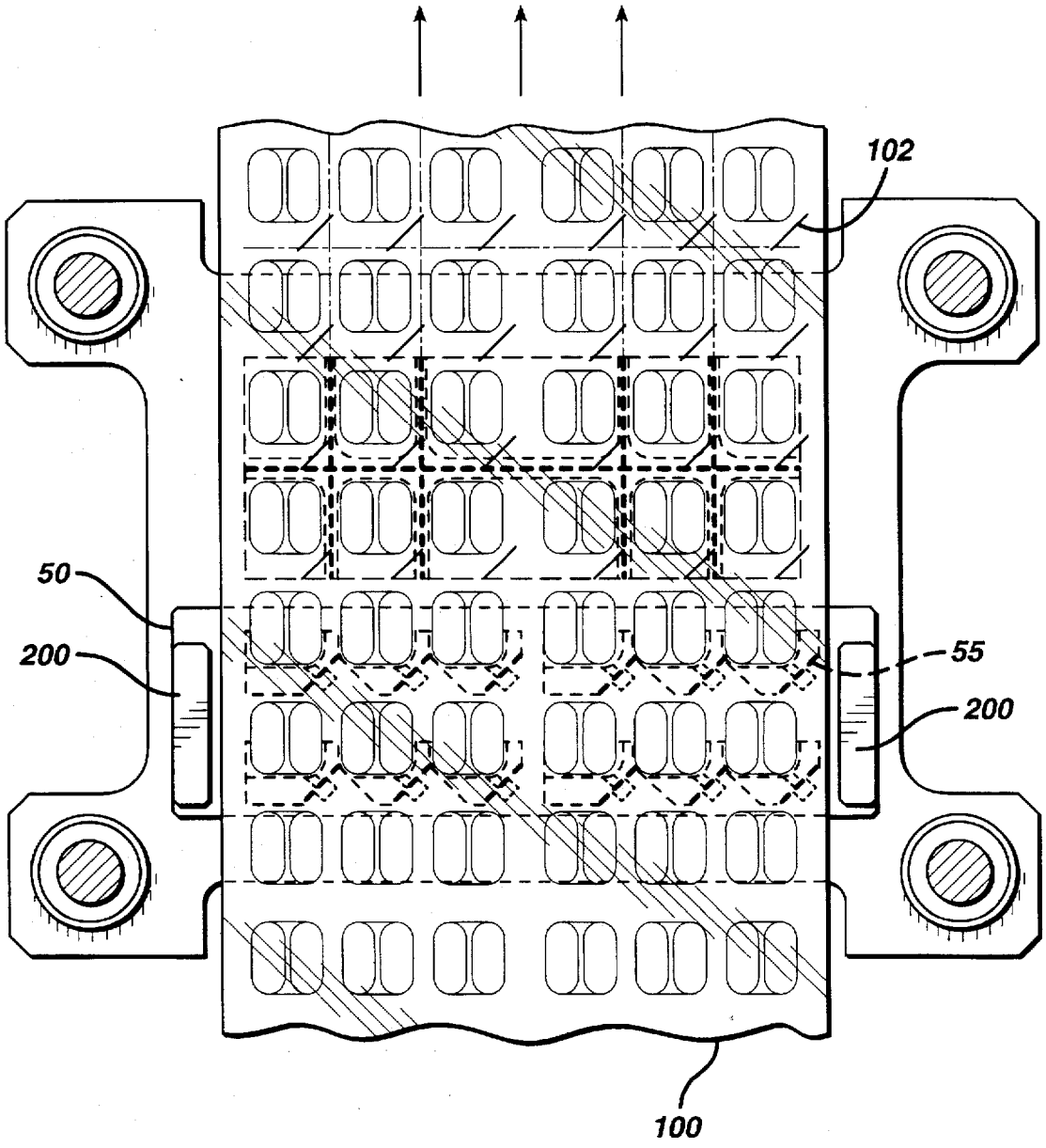
FIG. 4 is a plan view of the blister package placed on the plate of the machine of FIG. 1.

The improvement to the current invention is seen in FIGS. 3 and 4. Therein, the plate or bed 60 is now precision ground (typically hardened steel having a hardness valve of 60 to 65 Rockwell units and made floating on a set of springs 150. These springs 150 absorb any misalignment (either in depth or angle) of the parts during positioning of the plate 60 itself, or if, inadvertently, any parts are constructed outside their normal tolerances. Furthermore, the follower 30 which contains knife device 50 comprising the cutting apparatus is protected from the plate 60 by a flexible bellows 175. This bellows 175 eliminates dust and contamination.

The blister 100 is held onto the plate by guide rails, and now the depth of cut is determined exclusively by a gauge block 200 held against the plate 60 by the cam follower. In this fashion, cutting tool 50 now relies on forming a cut only on this differential distance "d" from the gauge block 200 to the edge of a knife 55, and not on any of the other potential inaccuracies disclosed above. Thus, the device now is able to much more accurately cut the blister packages 100, such as those as described in Ser. No. 08/550,901 entitled "Blister Pill Package With Safety Backing"; copending and commonly assigned to the assignee of the present invention, and herein incorporated by reference. The package blister cuts are now certainly in conformance with CR and SE testing.

In use therefore, the cutting of a blister package is performed as follows:

First, a large blister sheet is placed upon the bed of the machine. This blister sheet will generally be placed onto the package shape and is formed by a hot melt process at a prior station (not shown), commonly used in the art. The blister sheet contains a plurality of individual blister packages containing single or double dosage units of a particular analgesic. Typically, the blister will be in the shape of a two row sheet. The blister package is held by guide rails against the plate. Of course, there are a series of these blisters fed into the mechanism, so that they can be fed sequentially, onto the plate of the cutting machine. Once placed upon the plate and held thereon, the cutting mechanism is operated by the cam 20 to cause the knives 50 to come into contact with the blister 100. The depth of the blister score cut 102 is determined solely by the dimensional difference in the height of the score blade and gauge block placed on the blister bed plate 60. As there are no other extraneous factors, this is reliably held to within very small tolerances, as has been previously described. Then the package is cut, generally in the form of 2×6, 4×4 or 2×4 packages.

Once the blister package is cut as described herein, the package is thereafter placed in a sales container and put into commerce. Of course, if different packages are used wherein the number of tablets on a blister, or their arrangement is changed, the knives and gauge blocks can be adjusted so that in each instance the depth of the cut is reliably maintained. Minor changes in depths also can be made with different gauge blocks, without needing to change score blades, the cam follower or its stroke. Now, the device provides child resistant packages, while at the same time providing packages which are relatively easy for senior citizens to open.

What is claimed is:

1. In combination:

a. a machine for cutting having a work space with a cutting mechanism, comprising a plate wherein a material is held on said plate and the plate comes into contact with a cutting means comprising at least one knife blade, and wherein the cutting means is maintained at a certain predetermined distance away from the plate of the work space, the work space held by a spring means executing a spring force on the cutting means thereby isolated from motion of the remainder of said machine; and b. a blister package comprising the material held on said plate, said blister package useful for containing sealed products therein; and wherein the cutting means cuts said blister packages to a predetermined tolerance.

2. The combination of claim 1 wherein the knives are surrounded by covers.

3. The combination of claim 1 wherein said spring means holds the plate in a "pre-loaded position away from said knives.

4. The mechanism of claim 1 wherein the device is used to cut analgesic tablet blister packages.

5. In combination:

a. a machine for cutting having a work space with a cutting mechanism and comprising a plate wherein a material is held on said plate and the plate comes into contact with cutting means comprising at least one knife blade, and wherein the cutting means is maintained at a certain predetermined distance away from the plate of the work space, the work space held by a spring means executing a spring force on the cutting means thereby isolated from motion of the remainder of said machine;

a gauge block held on said plate;

b. a blister package comprising the material held on said plate, said blister package useful for containing sealed products therein; and said mechanism, bed and package held in a machine, but isolated from the remainder of said machine by said springs.

6. The combination of claim 5 wherein the knives are surrounded by covers.

7. The combination of claim 5 wherein said spring means holds the plate in a pre-loaded position away from said knives.

8. The combination of claim 5 wherein the device is used to cut analgesic tablet blister packages.

9. The combination of claim 1 comprising the material held on said plate, said blister package useful for containing sealed products therein.

* * * * *